US006170816B1

(12) United States Patent
Gillmann et al.

(10) Patent No.: US 6,170,816 B1
(45) Date of Patent: Jan. 9, 2001

(54) METHOD OF CONTROLLING A DEVICE FOR REMOVING FLAT ITEMS OF POST FROM A STACK

(75) Inventors: Hanno Gillmann, Constance; Hauke Lübben, Radolfzell, both of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/125,812

(22) PCT Filed: Feb. 14, 1997

(86) PCT No.: PCT/EP97/00706

§ 371 Date: Nov. 23, 1998

§ 102(e) Date: Nov. 23, 1998

(87) PCT Pub. No.: WO97/31726

PCT Pub. Date: Sep. 4, 1997

(30) Foreign Application Priority Data

Feb. 27, 1996 (DE) ..... 196 07 304

(51) Int. Cl.[7] ..... B65H 5/00

(52) U.S. Cl. ..... 271/10.03; 271/111; 271/265.02; 271/270

(58) Field of Search ..... 271/10.03, 110, 271/111, 265.01, 265.02, 270, 10.1

(56) References Cited

U.S. PATENT DOCUMENTS 4,077,620 * 3/1978 Frank et al. ..... 271/10.03
4,171,130 * 10/1979 Jeschke ..... 271/259
4,451,027 * 5/1984 Alper ..... 271/270
4,541,624 9/1985 Sasage et al. .
4,691,912 * 9/1987 Gillmann ..... 271/34
4,893,804 * 1/1990 Sasage et al. ..... 271/94
5,664,771 * 9/1997 Nagatani et al. ..... 271/265.02

FOREIGN PATENT DOCUMENTS

3319220A1 12/1983 (DE) .
3424397A1 1/1986 (DE) .
0057810A1 8/1982 (EP) .
0167091A1 1/1986 (EP) .

* cited by examiner

*Primary Examiner*—H. Grant Skaggs
(74) *Attorney, Agent, or Firm*—Venable; George H. Spencer; Robert Kinberg

(57) ABSTRACT

The invention concerns a method of controlling a device for removing flat items of post as a function of the spacing of the item of post to be removed from an item of post already removed, the actual spacing between the item to be removed and the removed item being determined, and the item to be removed being removed as soon as the actual spacing corresponds to a nominal spacing. According to the invention in order to reduce the difference between average gaps between the items of post and minimum gaps, the item of post to be removed is first accelerated to an intermediate speed value which is slower than a predetermined final speed. As soon as the actual spacing equals the nominal spacing, the item of post is accelerated to the final speed.

6 Claims, 1 Drawing Sheet

METHOD OF CONTROLLING A DEVICE FOR REMOVING FLAT ITEMS OF POST FROM A STACK

The invention relates to a method and a device for controlling the removal in accordance with the preamble of the independent claims.

EP 0 167 091 A1 discloses a device for removing flat items of mail from a stack. This device has a controlled removal element which draws off the respective frontmost item of mail from a stack and pushes it into the capture area of a pair of driven feed rollers, a measured section being arranged between the stack output and the feed rollers, the output signals of which section are fed to a control circuit. Here, the removal element is driven to remove an item of mail in such a way that the distance between the item of mail to be removed and an item which has already been removed is determined and the respective distance-measuring result is corrected by a prescribed value which is dependent on the acceleration travel of the object to be removed, the removal being initiated if the magnitude of the distance-measuring result corrected in this way corresponds to a set point distance value. Here, the use of the prescribed value makes it possible to take into account different mechanical properties of the different items of mail and their effect during the acceleration process.

A different behavior of the items of mail during the removal process also results from the different position of the items of mail in the stack from which the items of mail are being removed. The consequence of this is likewise that the central gaps between the items of mail and the minimum gap which must be maintained in order to supply downstream equipment, such as letter sorting devices, for example, with items of mail in an optimum way, are different from one another to an undesired higher degree. This difference has adverse effects on the throughput rate.

The object of the present invention is to specify a method and a device for removing flat items of mail from a stack, with which the difference between the central gap between the items of mail and the minimum gap can be reduced. This object is achieved according to the invention by means of the features of the independent patent claims.

The invention is based on the idea that the item of mail to be removed is initially accelerated to an intermediate speed value which is lower than a prescribed final speed, and that as soon as the actual distance is equal to the set point distance, the item of mail is accelerated to the final speed. The removal of an item of mail to be removed is carried out as a function of the position of the item of mail with respect to the removal element.

Advantageous embodiments of the invention can be found in the dependent claims and the description.

Figure 1:
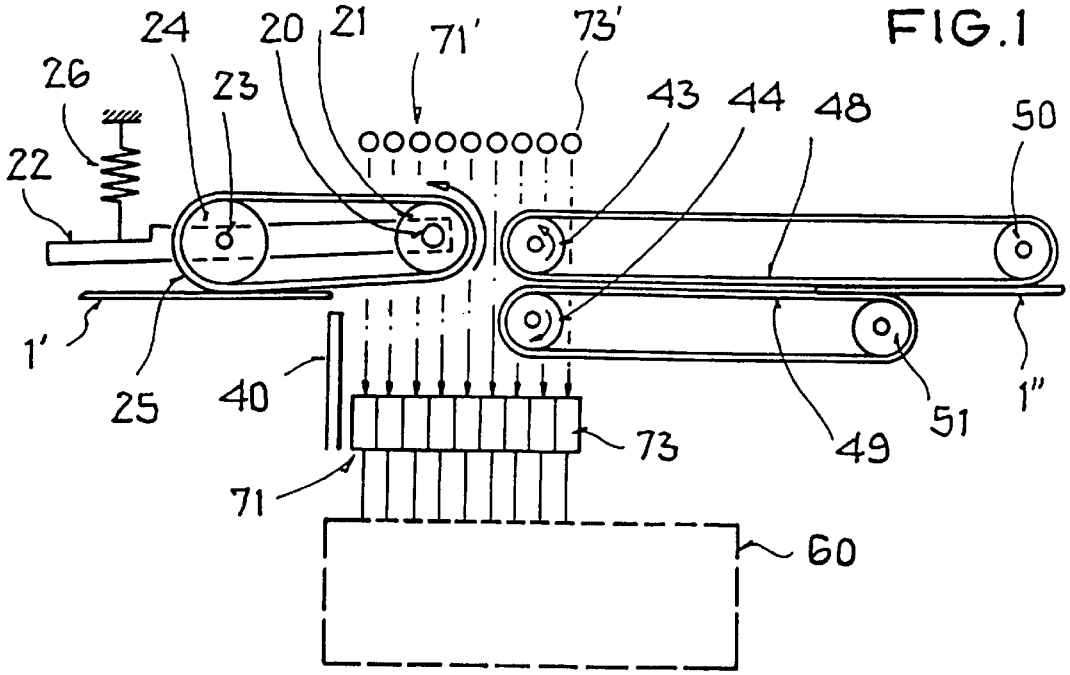
Figure 2:
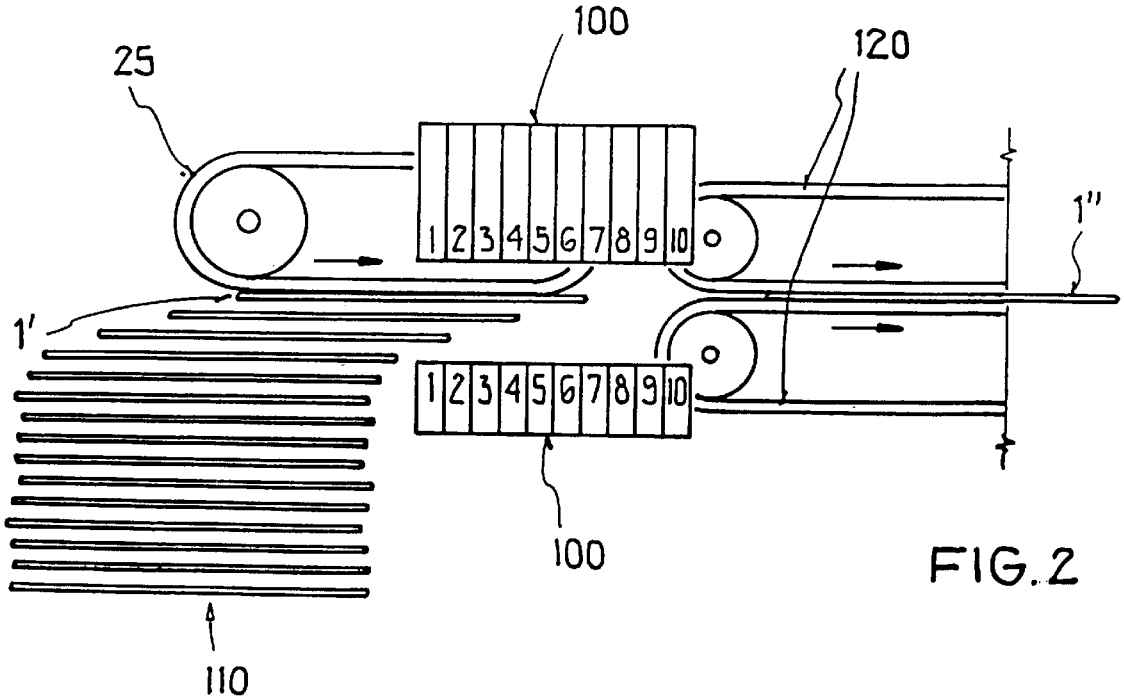

The invention will be explained in more detail below with reference to drawings, in which FIG. 1 shows a device according to the invention, FIG. 2 shows a simplified illustration of a device according to the invention in which the stack from which the items of mail are to be removed is illustrated.

FIG. 1 shows a preferred exemplary embodiment of a device according to the invention. Here, a shaft 20 is provided which is fixedly mounted but freely rotatable, and has a roller 21 attached to it. The shaft 20 also provides pivotable bearing to a rocker 22 which bears the axle 23 of a further roller 24. A removal strip 25, whose outer surface has a high coefficient of friction, is led around the roller 21 and the removal roller 24 as an isolating element.

The rocker 22 is supported by means of a schematically indicated spring 26, with the result that the respective position depends on the contact force of the stack of items of mail of which the frontmost item of mail 1' is shown during its removal. The free end of the rocker 22 acts on a microswitch which is not shown. If the contact force of the stack is too low, a normally-closed contact of the microswitch closes, causing a geared motor (not shown) to be switched on. This drives a supporting wall at the end of the stack in the direction of the removal roller 24 until the aforesaid normally closed contact switches off again after the position of the rocker corresponding to the pressing force provided has been reached.

The shaft 20 is driven by a servomotor (not illustrated) in a controlled manner in the direction of the arrow shown by a broken line in the illustration of the roller 20.

The edges pointing in the conveying direction, i.e. the front edges of the items of mail located in the stack, bear, more or less firmly against a stop wall 40, which leaves free, toward the removal strip 25, a gap which permits the items of mail to pass through, that is to say the stack outlet.

In the conveying path a pair of continuously driven conveying rollers 43 and 44 are arranged, by means of which the items of mail are positively conveyed on as soon as they pass into their capture area. These conveying rollers serve also as deflection rollers of conveying belts 48 and 49 which are led around further deflection rollers 50 and 51 in the conveying direction. While the driven conveying rollers 43 are fixedly mounted, the conveying roller 44 is resiliently mounted in a known fashion, for example on a pivoting lever, but this is not illustrated in the drawing for the sake of simplicity.

Along the conveying path of the items of mail, a measured section 71/71' is arranged adjacent to the stop wall 40. This measured section is designed in such a way that its output signals are a measure of the partial section of the respective measured section traveled through by the front edge of the item of mail 1' to be removed by the reference edge (rear edge) of the previously removed item of mail 1".

In the exemplary embodiment shown, the measured section 71/71' is formed by successive light barriers whose light receivers are designated by the reference symbol 71 and their associated light sources by 71'. Photodiodes or phototransistors are used as light receivers.

In addition, a light barrier 73/73' with light sources 73 which monitors the capture area of the conveying rollers 43 and 44 is provided.

These light barrier signals are evaluated by the microprocessor of the control circuit 60. The respective positions of the items of mail 1' and 1" are determined from the light/dark signals of the light barriers.

FIG. 2 shows a simplified illustration of a removal device in which a number of items of mail are arranged in a stack 110, the item of mail 1' which is to be removed protruding into the measured section 100/100'. An item of mail 1" which has already been removed is being conveyed between the conveying belts 120. In order to take into account the different removal behavior of items of mail with different properties, in particular also a different position in the stack 110 of items of mail, the removal of the items of mail takes place in two stages, it being possible to take into account the position of the item of mail to be removed with respect to the removal element. This means that the removal process of an item of mail to be removed is regulated on the basis of information relating to its own progress, so that the influence of properties of the preceeding, already removed items of mail on the removal process of the item of mail which is just being removed can be excluded. For this purpose, the item of mail to be removed is accelerated to a reduced removal speed, referred to below as intermediate speed, for example half the final speed. The removal is then started if there is already a detectable gap from the preceding item of mail which has already been removed. This gap must be of such a size that it can still be increased to the set point distance after the start. Here, the position of the item of mail to be removed can be taken into account at the moment of starting the removal process, i.e. the distance from the transferring belts 120. Likewise, the difference between the intermediate speed value and the prescribed final speed can be taken into account. The current distance between the two items of mail is monitored after the start of the removal process. As soon as the set point distance between the items of mail has been reached, which distance is essentially equal to the minimum distance which can still be processed in devices downstream, the machine is accelerated to the final speed. Here, all that is then necessary is to accelerate to the difference between the intermediate speed value and the final speed value. This occurs more quickly and with less uncertainty than the acceleration to the final speed value. The monitoring of the current distance is carried out with the aid of the light barriers and a section clock for the conveying belts 120. Preferably, a condition for the start of the removal process is that at least one light barrier of the measured section 100/100' is no longer without a light signal.

If the example of the device in FIG. 2 is considered, it is found, for example, that the removal process is started later if the front edge of the item of mail to be removed is located behind the light barrier 6 of the diode line, since otherwise an excessively small distance from the preceding item of mail is produced. On the other hand, the removal process is started earlier if the front edge is located in front of the light barrier 5, since otherwise the distance from the preceding item of mail would be unnecessarily large.

For the person skilled in the art it is self-evident that the distance between the items of mail can be referred to different removal edges, and that changes in the acceleration behavior due to the drive system of the removal device and/or the isolating properties of the items of mail to be isolated can be corrected automatically.

What is claimed is:

1. A method for controlling a device for removing flat items of mail from a stack as a function of the distance between an item of mail to be removed and an item of mail which has already been removed, comprising:

determining the actual distance of the item of mail to be removed from the item of mail which has been removed;

removing the item of mail to be removed as soon as the actual distance is greater than a set point distance which has been reduced by a prescribed correction value, the correction value being selected as a function of the acceleration path of the item of mail to be removed; and initially accelerating the item of mail to be removed to an intermediate speed and as soon as the actual distance is equal to the set point distance, accelerating the item of mail to a final speed.

2. The method as claimed in claim 1, including selecting the correction value as a function at least one of a position of the to be removed item of mail relative to a removal element and a difference between the final speed and intermediate speed.

3. The method as claimed in claim 1, wherein the intermediate speed is selected to be half the final speed.

4. The method as claimed in claim 2, wherein the intermediate speed is selected to be half of the final speed.

5. A removal device for feeding flat items of mail from a stack to a conveying element, comprising:

a control circuit for controlling removal of mail items from the stack as a function of an actual distance between an item of mail to be conveyed and an item of mail which has already been removed;

a measuring section, located within a conveying path of the conveying element arranged down stream of the stack, for measuring said actual distance and having output signals representing the measured actual distance that feed to the control circuit;

the control circuit having means which correct the respectively measured actual distance by a correction value which is dependent on the acceleration path of the item of mail to be removed, and which initiates the removal of the mail item to be removed if the magnitude of the corrected distance corresponds to a set point distance value; and a removal element by which the item of mail to be removed is initially accelerated to an intermediate speed which is lower than a prescribed final speed, and in that as soon as the actual distance is equal to the set point distance, the item of mail is accelerated to the final speed.

6. The device according to claim 5, wherein the control circuit contains only one clock generator.

* * * * *